US005082538A

United States Patent [19]

DeRespiris et al.

[11] Patent Number: 5,082,538

[45] Date of Patent: Jan. 21, 1992

[54] PROCESS FOR REPLENISHING METALS IN AQUEOUS ELECTROLYTE SOLUTIONS

[75] Inventors: Donald L. DeRespiris, Mentor; Eric J. Rudd, Painesville; Carolyn Schue, Huntsburg, all of Ohio

[73] Assignee: ELTECH Systems Corporation, Boca Raton, Fla.

[21] Appl. No.: 638,938

[22] Filed: Jan. 9, 1991

[51] Int. Cl.[5] ..... C25D 7/06; C25D 17/00

[52] U.S. Cl. ..... 205/140; 104/206; 205/138; 205/141; 205/142

[58] Field of Search ..... 204/28, 206, 234

[56] References Cited

U.S. PATENT DOCUMENTS

| | | | |
|---|---|---|---|
| 3,793,165 | 2/1974 | Juda et al. | 204/106 |
| 4,181,580 | 1/1980 | Kitayama et al. | 204/28 |
| 4,293,396 | 10/1981 | Allen et al. | 204/106 |
| 4,614,575 | 9/1986 | Juda et al. | 204/265 |
| 4,789,439 | 12/1988 | Bunk et al. | 204/28 |
| 4,900,406 | 2/1990 | Janssen | 204/28 |

*Primary Examiner*—T. M. Tufariello
*Attorney, Agent, or Firm*—John J. Freer

[57] ABSTRACT

A method and apparatus are disclosed for replenishing metal ions in an electrolyte depleted of the metal ions. A preferred example is replenishing tin in the electrolyte of an electrolytic tinning apparatus having an insoluble anode. The electrolyte thus becomes depleted of tin in the electrotinning process. The replenishment apparatus comprises an electrolytic cell including a tin anode, a cathode, and an electrolyte chamber for the tin anode and the cathode. The cathode is a gas diffusion electrode. An electrical circuit, usually having additional circuit resistance but free of connection to an external power source, connects the anode to the cathode. The electrolyte chamber has an electrolyte inlet, and an electrolyte outlet which is in flow communication with the electrolytic tinning apparatus. The gas diffusion electrode is exposed, on its gas side, to a source of gaseous reactant, e.g., oxygen.

When the anode and cathode of the electrolytic cell are connected together electrically, a current flows between the anode and the cathode, without an external power source. The current flow is at a current density which is effective to dissolve the tin of said tin anode into the electrolyte. The usual cell cathode reaction involves oxygen reduced to water in an acidic electrolyte.

41 Claims, 1 Drawing Sheet

PROCESS FOR REPLENISHING METALS IN AQUEOUS ELECTROLYTE SOLUTIONS

BACKGROUND OF THE INVENTION

1. Technical Field

The present invention relates broadly to the replenishment of metals in aqueous electrolyte solutions. The present invention will be particularly described with respect to the replenishment of tin in an acidic electrotinning bath, wherein the electrotinning is carried out with an insoluble anode depleting tin ions from the bath.

2. Description of the Prior Art

U.S. Pat. No. 4,181,580 describes a process for electrotinning steel strip in an electrolytic bath. The steel strip is the cathode and the anode is an insoluble metal plate positioned in the bath. The patent discloses several advantages achieved by the use of an insoluble anode rather than a soluble anode. However, an insoluble anode requires that the tin in the electrolytic bath be replenished. In U.S. Pat. No. 4,181,580, this is accomplished by withdrawing electrolyte from the electrolytic bath to a reactor which is exterior to the bath. The reactor contains a bed of tin in particulate form. Oxygen is introduced into the reactor and reacts with the tin to dissolve the tin. The rate of dissolution of the tin is controlled by the amount of oxygen which is introduced into the reactor. The rate of dissolution maintains the concentration of dissolved tin in the electrolytic bath at a desired level.

A primary problem with this process is that the oxygen also promotes the reaction of dissolved $Sn^{+2}$ to $Sn^{+4}$ so that an amount of dissolved tin is converted into a sludge which has to be removed from the electrolyte. This requires the use of a separate sludge removal system.

U.S. Pat. No. 4,789,439 discloses a process which purports to avoid the need for a sludge removal system. In this process, electrolyte is withdrawn from an electrolytic tinning bath and is fed into the anode chamber of an electrolytic cell. The anode chamber contains a bed of tin particles. The cathode and anode chambers are separated by a tin impermeable membrane. A power source connected to the electrolytic cell provides an electric current by which tin ions are formed electrolytically in the reaction $$Sn \rightarrow Sn^{+2} + 2e^-$$

and are added to the electrolyte.

One problem with this process is that an external power source is needed, to drive the reaction, and this adds to the cost of electrotinning. In addition, efficient operation of the electrolytic cell requires that the tin particles be in good contact with each other for the flow of current. If the particles are not in good contact, the cell resistance is increased. This causes the potential at the anode to increase, which can result in the evolution of oxygen at the anode and formation of $Sn^{+4}$ and tin sludge.

U.S. Pat. No. 3,793,165 discloses an electrochemical cell for electrowinning a metal from an acidic salt solution of the metal. A cathode is immersed in the salt solution, and the salt solution functions as the cell catholyte. A gas diffusion electrode functions as the cell anode. The anolyte is an acid such as sulfuric acid. Hydrogen is introduced on the gas side of the anode. A diffusion diaphragm permeable to the anolyte separates the anode from the cell catholyte. When the anode and cathode are electrically connected together, the metal is reduced at the cell cathode depositing on the cathode. The electrodeposition occurs without the need for an external power source. The process is suitable for electrowinning metals below hydrogen in oxidation potential, such as copper or zinc. Similar subject matters are disclosed in related U.S. Pat. Nos. 4,293,396 and 4,614,575.

SUMMARY OF THE INVENTION

The present invention resides broadly in a method and apparatus for replenishing metal ions depleted from an electrolyte. An example of one such electrolyte is an electroplating bath of an electroplating apparatus in which the anode of the electroplating apparatus is insoluble in the bath. Thus, the bath becomes depleted of metal ions during the electroplating process. The apparatus for replenishing metal ions comprises an electrolytic cell which has an anode of the metal of said metal ions, a cathode, and means for circulating the electrolyte of said electrolytic cell to and from a source, e.g., the electroplating apparatus, wherein the metal ions are depleted from the electrolyte. The electrolytic cell of the present invention receives from the source an electrolyte depleted of metal ions and returns to the source an electrolyte enriched in metal ions. In a broad aspect, the improvement of the present invention comprises using as the cathode of the electrolytic cell a gas diffusion electrode.

The present invention is applicable to any electrolyte containing metal ions of a metal having a dissolution potential more negative than the potential at which oxygen is reduced at an electrode. Included are metals selected from the group consisting of tin, copper, iron, nickel, chromium, cobalt, zinc, lead and cadmium.

The electrolyte will most always be either an aqueous acidic electrolyte or an aqueous alkaline electrolyte.

The present invention is particularly applicable to a method and replenishment apparatus for replenishing tin in the electrolyte of an electrolytic tinning apparatus having an insoluble anode. The replenishment apparatus comprises an electrolytic cell including a tin anode, a cathode, and an electrolyte chamber between the tin anode and the cathode. The cathode is a gas diffusion electrode. An electrical circuit, usually having additional circuit resistance, connects the anode to the cathode. This circuit is free of connection to any external electrical power source. The electrolyte chamber has an electrolyte inlet, and an electrolyte outlet which is in flow communication with the electrolytic tinning apparatus. The electrolytic cell receives at the inlet an electrolyte which is depleted of tin ($Sn^{+2}$) ions, and provides at the outlet an electrolyte which is enriched in tin ($Sn^{+2}$) ions. The gas diffusion electrode is exposed, on its gas side, to a source of gaseous fuel, typically oxygen.

When the anode and cathode are connected together electrically, a current is generated between the anode and cathode, without an external power source. The current flow is at a current density which is effective to dissolve the tin of said tin anode into the electrolyte. Gaseous reactant, e.g., oxygen, is reduced to water at the cell cathode in an acidic electrolyte.

BRIEF DESCRIPTION OF THE DRAWING

Further features of the present invention will become apparent to those skilled in the art from reading the following specification with reference to the accompanying drawings, in which.

DESCRIPTION OF PREFERRED EMBODIMENTS

Figures 1, 2:
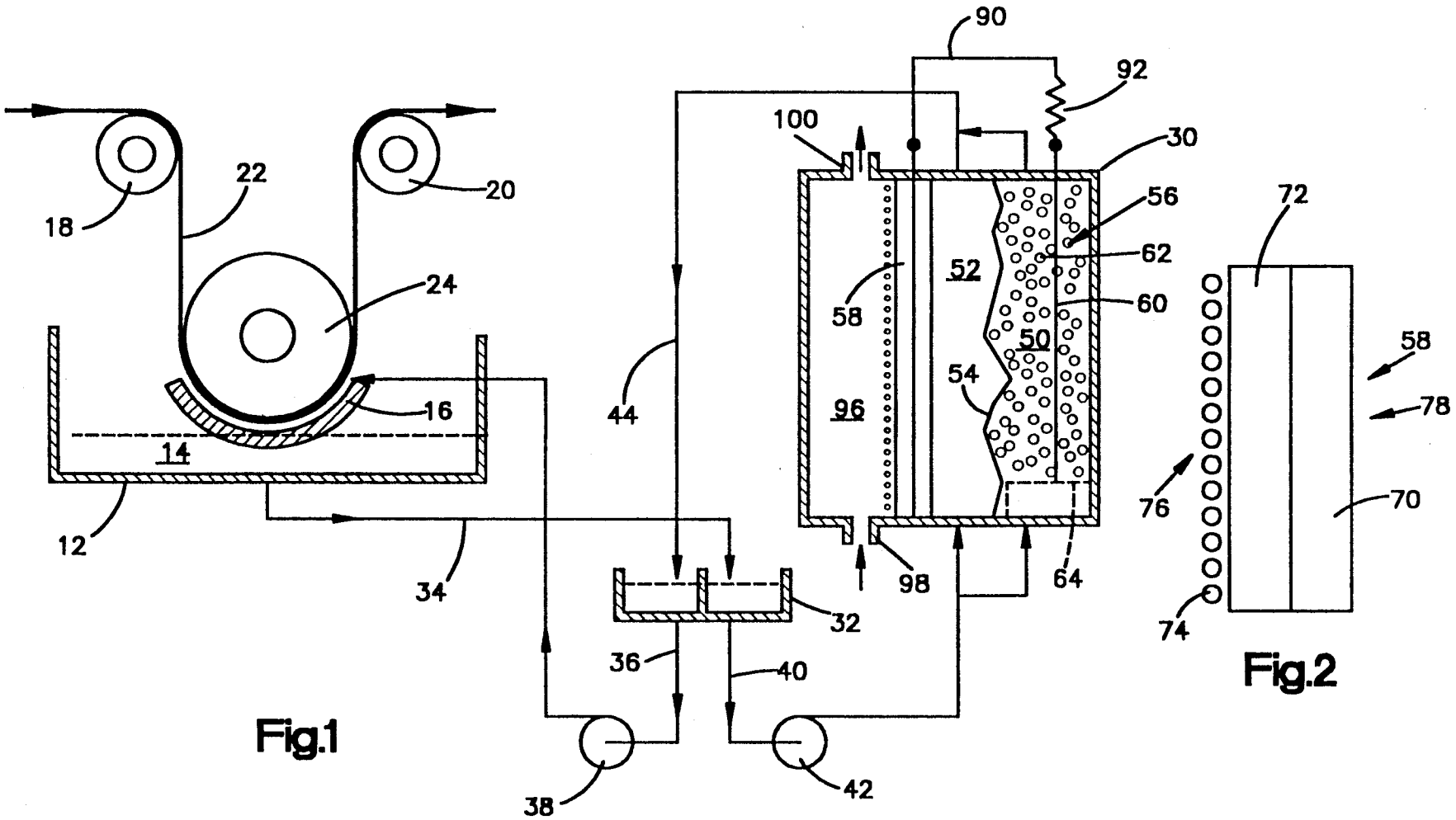
FIG. 1 is a schematic flow diagram illustrating the process of the present invention.
FIG. 2 is a schematic enlarged view of a gas diffusion electrode used in the process of FIG. 1.

The present invention relates broadly to replenishing metal ions in an electrolyte obtained from a source in which the metal ions were depleted from the electrolyte. The present invention will be particularly described with respect to replenishing metal ions depleted from an electrolyte employed in an electroplating apparatus, although it will be apparent to those skilled in the art that the present invention is also applicable to replenishing metal ions depleted from an electrolyte in other ways. For instance, the present invention is applicable to replenishing metal ions depleted from a salt bath in the manufacture of salts, for instance salts precipitated from a solution by cooling, solvent evaporation, addition of seed crystals, and solvent replacement. Broadly, such apparatus, whether an electroplating apparatus, or an apparatus employed in the manufacture of salts, can be characterized, for purposes of the present application, as a source of depletion of metal ions from an electrolyte.

The following description, relates specifically to an electroplating apparatus. More specifically, the following description relates to an electrotinning apparatus, as a source of depletion of tin ions from an electrolyte, and an electrolytic cell for replenishing tin ions in the electrolyte. However, it will be apparent to those skilled in the art that the following description is also applicable to plating other metals onto a substrate, and to replenishing such metals in an electrolyte. Other metals are those having a dissolution potential more negative than the potential at which oxygen is reduced at an electrode, such as copper, iron, nickel, chromium, cobalt, zinc, lead and cadmium.

Referring to FIG. 1, an electroplating apparatus, e.g., an electrotinning apparatus, comprises an electrolyte housing 12 containing a tin or other metal electrolyte 14. An electroplating cell comprises a radial type anode 16 and a cathode metal strip 22 which passes around rollers 18, 20 and 24. The cathode strip 22 may be cathodically charged by any of the rollers 18, 20 and 24 by means not shown. Instead of a radial type anode 16, a flat anode can be employed. It will be understood that the strip 22 as such is referred to herein is meant to include metal for coating and in elongated form, e.g., a strip from a coil or a strand or wire from a spool.

The liquid electrolyte 14 in the housing 12 can be either an acid electrolyte or an alkaline electrolyte. For electrotinning, a preferred electrolyte is an acid electrolyte containing tin ions. Examples of suitable acid electrolytes containing tin ions are aqueous electrolytes containing methyl sulfonic acid, phenol sulfonic acids or salts thereof. An example of an alkaline electrolyte containing tin ions is one containing $Na_2SnO_3/NaOH$, having a pH between about 8 and 14. Well known plating baths are available as the electrolyte for use when plating other metals, such as copper, iron, nickel, chromium, cobalt, zinc and cadmium.

The anode 16 is a nonconsumable or insoluble anode in the electrolyte. It is understood that a combination of soluble and insoluble anodes can also be used. An example of one suitable insoluble anode is a valve metal substrate such as titanium coated with an electrocatalytic layer as represented by a precious metal, or mixed metal oxides, such as of platinum, ruthenium, rhodium, and iridium.

Under the influence of an electric field between the strip 22, as the cathode, and the non-consumable anode 16, tin or other metal ions are deposited from the electrolyte in the electroplating cell onto the strip 22. This depletes the electrolyte of metal ions. Electrolyte flows from the electroplating cell into the housing 12. It is understood that the depletion is only partial and that the electrolyte 14 even following electroplating contains a significant concentration of metal ions.

Since tin or other metal ions are continuously removed from the electrolyte during the electroplating of strip 22, it is necessary to replenish the electrolyte 14 with tin or other metal ions.

The replenishing apparatus of the present invention comprises an electrolytic cell 30 and a holding tank 32 between the electrolytic cell 30 and the electroplating cell. The electrolyte 14, depleted of tin or other metal ions, is removed from housing 12 in line 34 leading to the holding tank 32. By means of line 36, containing pump 38, concentrated electrolyte replenished with tin, or other metal, is returned from the holding tank 32 to the electroplating cell, which comprises anode 16, and the metal cathode strip 22. To obtain a concentrated electrolyte of tin or other metal ions, in holding tank 32, electrolyte from the holding tank 32 is continuously circulated to the electrolytic cell 30, through feed line 40 and pump 42, and returned from the electrolytic cell 30 back to the holding tank 32 in return line 44. Thus, feed line 40 contains electrolyte depleted of metal ions, whereas return line 44 contains electrolyte enriched in metal ions. It is understood that the term "enriched" can mean "concentrated" or "saturated". Preferably, the electrolyte is enriched, in electrolytic cell 30, to provide at least a concentrated electrolyte in return line 44, i.e., concentrated in metal ions.

The electrolytic cell 30 is preferably divided into an anode chamber 50 and a cathode chamber 52. This anode chamber 50 and cathode chamber 52 may be separated by an air impermeable separator 54. The separator 54 can be permeable to the flow of metal ions such as tin ($Sn^{+2}$), and essentially impermeable to the flow of oxygen or air. The separator 54 extends across the electrolytic cell 30 from top to bottom.

The separator 54 must be resistant to the electrolyte. A preferred separator 54 is an essentially air or oxygen impermeable membrane. One suitable membrane for an aqueous acid electrolyte such as methyl sulfonic acid or phenol sulfonic acid, containing tin ions, is a perfluorinated copolymer having pendant cation exchange functional groups such as a perfluorocarbon membrane marketed by E. I. Dupont deNemours & Co. under the trademark "NAFION". Examples of other suitable membranes are those made of sulfonated polystyrene, divinylbenzene, and other similar hydrocarbon or sulfonated hydrocarbon materials. The separator 54 can also be a porous diaphragm. Examples of suitable porous diaphragms are those made from such compositions as polypropylene, polyvinylidene fluoride and polyvinyl chloride. One suitable polyvinylidene fluoride diaphragm is marketed by Porex Technologies Corp. under the trademark "POREX". It will be understood that the separator 54, as a membrane or porous diaphragm, can be a barrier surface layer applied directly to the surface of the cathode 58 facing the cathode chamber. It is also contemplated that other means, e.g., enhanced hydrostatic pressure on the anode chamber 50, may be used to reduce or eliminate oxygen permeation.

Anode 56 is situated within the anode chamber 50, and a cathode 58 bonds the cathode chamber 52 at one side. The anode 56 is consumable and of tin or other metal to introduce tin ions or other metal ions into the electrolyte in the cell 30. For instance, with regard to tin as an example, the following reaction takes place:

$$Sn \rightarrow Sn^{2+} + 2e^-$$

A number of configurations for the anode 56 are possible. In the embodiment illustrated in the Figure, the anode 56 comprises an insoluble contact 60 embedded in loosely packed particles of tin 62. By the term "insoluble", it is meant that the contact strip 60 is insoluble in the electrolyte within the cell 30. In this respect, the contact strip 60 can be made of the same material as anode 16 of the electroplating cell, e.g., titanium or a titanium clad metal. The tin particles 62 are on the anode side of the membrane 54, in the anode chamber, and are loosely packed around the contact strip 60 on top of a perforated plate 64 at the bottom of the anode chamber. Instead of loose particles of tin or other metal in the anode chamber 50, the anode can be monolithic metal, e.g., a foil or plate of tin or other metal connected to an insoluble contact 60. The tin or other metal, whether in particulate form or foil or plate form, can be replenished in the cell 30 on either a batch or continuous basis, through a feed aperture (not shown) leading into the anode chamber. The electrolyte preferably is introduced, in line 40, into both the cathode chamber 52 and the anode chamber 50, as shown in FIG. 1. When the anode is particulate, as shown in FIG. 1, the flow is preferably controlled, for instance by flow restrictors (not shown), so that the flow rate through the anode chamber is less than that through the cathode chamber. The porous plate 64 allows the particles 62 to fluidize in the anode chamber under the influence of the flow through the anode chamber. However, for the passage of current in the replenishment cell, from the anode to the cathode, to be efficient it is desirable to maintain particle-to-particle contact of the tin or other metal particles requiring a relatively low flow of electrolyte through the anode chamber 50 compared to the flow through the cathode chamber. The overall rate of flow of the electrolyte through the electrolytic cell 30, controlled by pump 42, is that required to provide an enriched flow in return line 44, preferably a "concentrated" or "saturated" flow.

Details of the cathode 58 are illustrated in FIG. 2. The cathode is a gas diffusion electrode such as disclosed in prior U.S. Pat. Nos. 4,500,647; 4,877,694; and 4,927,514, assigned to the assignee of the present application. The disclosures of these patents are incorporated herein by reference.

The reaction at the cathode can be exemplified by the reduction of oxygen to water, in accordance with the following reaction:

$$O_2 + 4H^+ + 4e^- \rightarrow 2H_2O$$

As shown in FIG. 2, the gas diffusion electrode (cathode 58) comprises three layers 70, 72 and 74, which are laminated together. The gas diffusion electrode has a gas side 76 and an electrolyte side 78. Layer 74 is a current collecting layer. The current collection can be on either the gas side 76 or the electrolyte side 78, or on both sides. In the illustration of FIG. 2, the current collection is on the gas side 76. The layer 72 on the gas side 76 is a wet proofing layer of hydrophobic material such as polytetrafluorethylene (PTFE). Since the current collection is on the gas side 76, in FIG. 2, the PTFE may be mixed with an electroconductive carbon or other conductive agent to produce a layer 72 having a sufficiently low resistivity to permit use of the layer in fabrication of an electrode. If the current collecting layer 74 is only on the electrolyte side 78 of the electrode, then the layer 72 need not contain an electroconductive carbon or other conductive agent. The gas side, wet proofing layer 72 also has a high permeability to the reactant gas (e.g., oxygen). The purpose of the wet-proofing layer 72 is to prevent electrolyte from coming through the gas diffusion electrode and wetting the gas side 76 of the electrode. The layer 72 is also referred to as a backing layer.

The layer 70 on the electrolyte side 78 of the electrode is an active layer comprising a matrixing component and an active carbon component, such as carbon particles catalyzed with a precious metal such as platinum. The layer 70 can also contain a hydrophobic component, and can contain carbon black, and provides adequate pathways for the reactant gas. The matrixing component is a hydrophilic polymer forming a network into which the active carbon particles, and carbon black, if used, are bound. One example of a matrixing component is a hydrophobic polymer such as polytetrafluoroethylene (PTFE). There are many ways to make the active layer. One way, disclosed in U.S. Pat. No. 4,500,647, comprises preparing a dilute dispersion of particles of polytetrafluoroethylene and carbon black in water. The aqueous dispersion is dried, and then thoroughly mixed with the active carbon particles impregnated with a minor amount of the precious metal catalyst. The intimate mixture is fibrillated and then formed into an active layer, for instance by rolling the mix into a sheet at 50°-100° C.

The current collector layer 74 is shown in FIG. 2 as being applied to the gas side 76 onto the exposed surface of the wet-proofing layer 72. Suitable collector layers for application to the gas side are a nickel grid or carbon cloth. The current collector layer 74 may also be positioned next to and laminated next to the working surface of the layer 70. If so positioned, the current collector layer should be non-reactive with the electrolyte. A suitable current collector layer for the electrolyte side of the electrode 58 is a titanium or titanium clad metal grid. The current collector layer can also be, as mentioned, on both the gas side and electrolyte side of the gas diffusion electrode. In the embodiment illustrated in FIG. 2, the current collector layer 74 is adhered to the gas diffusion layer and is a nickel grid.

Referring to FIG. 1, the cathode 58 and anode contact strip 60 are electrically connected together by means of an electrical circuit 90. This electrical circuit 90 will offer a resistance, e.g., the resistance inherent in the material, such as copper wire, of the circuit itself. Additional electrical resistance 92 for the circuit 90, which additional resistance is also referred to herein as the circuit "having a circuit resistance" can be provided. For electrotinning it is preferred that the circuit 90 have such additional resistance. A characteristic of the present invention is that the cell 30 functions without the need for a power source in circuit 90. In operation, the closed circuit 90 establishes a potential between the anode 56 and the cathode 58. This provides a current flow from the cathode to the anode which is at a current density effective for dissolving the tin or other metal of the anode 56 into the electrolyte in the anode chamber 50. Although the cell 30 functions without the need for an external power source in circuit 90, it will be understood that such power source may be used. Some of the tin ions or other metal dissolved in the electrolyte remain in the electrolyte and flow from the anode chamber into the return line 44 by connection therewith to the anode chamber. Some of the tin or other metal ions flow in the direction of the cathode through separator 54 and flow into the return line 44 by connection therewith to the cathode chamber. Gaseous reactant, e.g., oxygen, on the gas side of the gas diffusion electrode 58 flows through the backing layer 72 (FIG. 2) of the electrode reacting at the active layer 70 to give up electrons. If some gaseous reactant, as for example oxygen, enters the electrolyte in the cathode chamber 52, the separator 54, when present, prevents the flow of the oxygen to the anode 56. This prevents the reaction of $Sn+2$ ions to $Sn+4$ ions and the formation of a sludge which then has to be removed from the electrolyte. It will be understood that the separator 54 can be eliminated, as with systems where reaction of anode products with oxygen is not a concern.

The electrolytic cell 30, on the gas side 76 of the gas diffusion electrode comprises a plenum chamber 96 into which gas flows through inlet 98 and out of which gas flows through outlet 100. The gas, e.g., air or oxygen, may be forced into the plenum chamber 96 by a pump (not shown) or the gas flow in the plenum chamber 96 can be by natural convection.

The following Example illustrates the present invention in more detail.

Example

A primary tin-air cell, similar to the electrolytic cell 30 of FIG. 1, was made. The cell contained a tin foil anode which was 9.3 centimeters square and weighed 1.315 grams. The tin foil anode was attached to a nickel contact plate. The cathode was a gas diffusion electrode having on the electrolyte side a platinum-catalyzed carbon/teflon structure and on the gas side a carbon/teflon structure. A nickel current collector grid was affixed to the gas side. The electrolyte in the cell was about 7 milliliters of 2.5 molar aqueous methane sulfonic acid having a conductivity at room temperature of $3\times10^{-1}$ mhos/centimeter. The gas supply was ambient air. The cathode and anode were connected together electrically. The circuit contained no power source external to the cell. The cell had an open circuit voltage of about 1.05 volts. A variable resistor was inserted into the circuit. The cell was allowed to operate at different circuit resistances. At each resistance setting, the voltage drop across the resistor was measured, from which the current flow in the cell was calculated. In addition, the cell voltage was measured at each resistance setting. The following Table 1 gives current densities in the cell and cell voltages at different resistance settings of the variable resistor.

TABLE 1

| Resistance/Ohms | Current Density Milliamps/cm$^2$ | Cell Voltage Volts |
|---|---|---|
| 200 | 0.38 | 0.92 |

TABLE 1-continued

| Resistance/Ohms | Current Density Milliamps/cm$^2$ | Cell Voltage Volts |
|---|---|---|
| 100 | 0.76 | 0.82 |
| 50 | 1.35 | 0.79 |
| 30 | 1.84 | 0.73 |
| 20 | 3.1 | 0.67 |
| 10 | 5.65 | 0.56 |
| 5 | 7.5 | 0.49 |
| 3 | 10 | 0.41 |
| 1 | 17.5 | 0.26 |

The above data showed that reasonable cell voltages in the range of 0.82 to 0.41 volts could be obtained giving reasonable current densities in the range of about one to about ten milliamps per cm$^2$.

A cell was then allowed to run at 20 ohms resistance. The cell polarized at a current density of about 3.5 milliamps per cm$^2$. After several hours of running, 280 milligrams of tin were dissolved to give a solution containing 0.34 molar divalent tin. The tin foil was entirely dissolved in one area exposing the nickel contact.

The cell of this Example contained no separator between the anode and cathode. Whereas a separator 54, in FIG. 1, may not be required, it may be advantageous to prevent oxygen, which may enter the cell at cathode 58, from flowing to the anode 56. Any separator resistant to electrolyte and permeable to the transport of $Sn^{+2}$ ions but essentially impermeable to the transport of oxygen, such as a Nafion (trademark, E. I. DuPont deNemours & Co.) membrane, may be used.

From the above description of the invention, those skilled in the art will perceive improvements, changes and modifications. Such improvements, changes and modifications within the skill of the art are intended to be covered by the appended claims.

Having described the invention, the following is claimed:

1. In a replenishment electrolytic cell for replenishing metal ions depleted from an electrolyte wherein said cell comprises an anode of the metal of said metal ions, a cathode, an electrical circuit connecting said anode and said cathode, and means for circulating said electrolyte to a source in which the metal ions are depleted from the electrolyte, the improvement wherein said cathode is a gas diffusion electrode.

2. The cell of claim 1 wherein said gas diffusion electrode is oxygen consuming and said metal ions are selected from the group consisting of tin, copper, iron, nickel, chromium, cobalt, zinc, lead and cadmium, said electrical circuit being free of a power source.

3. The cell of claim 2 wherein said electrolyte is an electrolytic plating solution containing said metal ions.

4. The cell of claim 1 wherein said electrolyte is an acidic electrotinning bath and said source is an electrotinning apparatus having an insoluble anode, said gas diffusion electrode being an oxygen consuming cathode in said replenishment electrolytic cell.

5. The cell of claim 4 comprising a tin anode, said electrical circuit being free of an external power source.

6. In a replenishment electrolytic cell for replenishing tin in the electrolyte of an electrolytic tinning apparatus having an insoluble anode, the improvement in said cell comprising a gas diffusion electrode for said cell.

7. The cell of claim 6 comprising an electrical circuit which is free of an external power source.

8. A replenishment electrolytic cell for replenishing metal ions depleted from a concentrated electrolyte containing said metal ions, comprising:

an electrolytic chamber;

means communicating said electrolytic chamber with a source of electrolyte depleted of said metal ions;

an anode comprising the metal of said metal ions;

a cathode, said cathode being a gas diffusion electrode;

an electrical circuit connecting said anode and said cathode; and means for flowing said electrolyte in said electrolytic chamber at a rate effective to obtain said concentrated electrolyte.

9. The cell of claim 8 wherein said source of electrolyte is an electroplating apparatus comprising an insoluble anode.

10. The cell of claim 9 wherein said metal ions are of a metal selected from the group consisting of tin, copper, iron, nickel, chromium, cobalt, zinc, lead and cadmium.

11. The cell of claim 9 wherein said electroplating apparatus is an electrotinning apparatus having an insoluble anode and said electrolyte is an acidic electrotinning bath, said cell anode being a tin anode.

12. A replenishment electrolytic cell for replenishing tin in the electrolyte of an electrolytic tinning apparatus having an insoluble anode, comprising:

a tin anode;

a cathode, said cathode being a gas diffusion electrode;

an electrolyte chamber between the anode and the cathode;

an electrical circuit having a circuit resistance between said anode and said cathode; and an electrolyte outlet from said electrolyte chamber in flow communication with said electrolytic tinning apparatus.

13. The cell of claim 12 wherein said electrical circuit is free of an external power source.

14. The cell of claim 12 comprising a separator between said anode and said cathode.

15. The cell of claim 14 wherein said separator is a membrane or a porous diaphragm.

16. The cell of claim 14 wherein said separator is a barrier surface layer o said cathode.

17. The cell of claim 12 wherein said anode comprises tin particles or monolithic tin.

18. The cell of claim 12 further comprising a source of oxygen on the gas side of said gas diffusion electrode.

19. An electrotinning apparatus comprising:

an electrolytic tinning bath;

an insoluble anode in said bath;

means for passing a metal strip which is to be tinned into said bath, said metal strip being spaced from said anode by a gap immersed in said bath;

means for introducing an acidic liquid electrolyte including tin ions into said bath;

means for establishing an electrical circuit between the anode and said metal strip;

a replenishing cell for replenishing tin in the electrolyte of said electrotinning apparatus;

said replenishing cell comprising:

a tin anode;

a cathode, said cathode being a gas diffusion electrode;

an electrolyte chamber between the tin anode and said cell cathode;

an electrical circuit having a circuit resistance between said cell anode and said cell cathode; and an electrolyte outlet from said electrolyte chamber in flow communication with said electrotinning apparatus bath.

20. The apparatus of claim 19 in which the electrical circuit of said replenishing cell is free of an external power source.

21. The apparatus of claim 19 wherein said replenishing cell comprises a separator between said cell anode and said cell cathode.

22. The apparatus of claim 19 wherein said separator is a membrane or a porous diaphragm.

23. The apparatus of claim 20 wherein said separator is a barrier surface layer on said cathode 24. The apparatus of claim 17 wherein said cell anode comprises tin particles or monolithic tin.

25. The apparatus of claim 19 including a source of oxygen in gas communication with the gas side of said gas diffusion electrode.

26. The apparatus of claim 19 comprising an acidic electrolyte containing one or more of methyl sulfonic acid or phenol sulfonic acid or salts thereof.

27. A method for replenishing metal ions in an electrolyte depleted of metal ions comprising the steps of:

(a) providing an electrolytic cell comprising (1) an anode of the metal of said metal ions;

(2) a cathode, said cathode being a gas diffusion electrode; and (3) an electrolyte chamber for said anode and said cathode;

(b) introducing an electrolyte depleted of metal ions into said electrolyte chamber;

(c) electrically connecting said cell anode and said cell cathode and allowing current to flow at a current density effective to dissolve the metal of said metal anode into said electrolyte; and (d) flowing said electrolyte enriched in the metal of said metal ions to the source of said electrolyte depleted of metal ions.

28. The method of claim 27 wherein said source of electrolyte depleted of metal ions is an electrotinning apparatus having a non-consumable anode and the anode of said electrolytic cell is a tin anode.

29. The method of claim 28 wherein said electrolyte is an acid electrolyte containing one or more of methyl sulfonic acid, phenol sulfonic acid or salts thereof 30. A method for replenishing tin in the electrolyte of an electrolytic tinning apparatus, having an insoluble anode, comprising the steps of:

(a) providing an electrolytic cell comprising:

(1) a tin anode;

(2) a cathode, said cathode being a gas diffusion electrode; and (3) an electrolyte chamber for the tin anode and the cathode;

(b) introducing an electrolyte into said electrolyte chamber;

(c) electrically connecting said cell anode and cell cathode and allowing current to flow at a current density effective to dissolve the tin of said tin anode into said electrolyte; and (d) flowing said electrolyte with the dissolved tin therein to said electrolytic tinning apparatus.

31. The method of claim 30 wherein said electrolytic cell comprises an electrical circuit free of a power source.

32. The method of claim 30 wherein said electrolytic cell comprises a separator between said anode and said cathode.

33. The method of claim 30 wherein said cell anode comprises tin particles or monolithic tin.

34. The method of claim 30 comprising providing a source of oxygen on the gas side of said gas diffusion electrode.

35. The method of claim 30 wherein said electrolyte comprises one or more of methyl sulfonic acid, phenol sulfonic acid or salts thereof.

36. A method for electrolytic tinning comprising the steps of:

(1) providing an electrolytic tinning apparatus having an insoluble anode;

(2) providing an electrolytic cell comprising:

(a) a tin anode;

(b) a cathode, said cathode being a gas diffusion electrode; and (c) an electrolyte chamber between the tin anode and the cathode;

(3) introducing an electrolyte into said electrolyte chamber;

(4) electrically connecting said cell anode and cell cathode and allowing current to flow at a current density effective to dissolve the tin of said tin anode into said electrolyte; and (5) flowing said electrolyte with the dissolved tin therein to said electrolytic tinning apparatus.

37. The method of claim 36 wherein said electrolytic cell comprises an electrical circuit free of a power source.

38. The method of claim 36 wherein said electrolytic cell comprises a separator between said anode and said cathode.

39. The method of claim 36 wherein said cell anode comprises tin particles or monolithic tin.

40. The method of claim 36 comprising providing a source of oxygen on the gas side of said gas diffusion electrode.

41. The method of claim 36 wherein said electrolyte comprises one or more of methyl sulfonic acid, phenol sulfonic acid or salts thereof.

* * * * *